US010253418B2

(12) United States Patent
Allely et al.

(10) Patent No.: US 10,253,418 B2
(45) Date of Patent: Apr. 9, 2019

(54) STEEL SHEET PROVIDED WITH A COATING OFFERING SACRIFICIAL CATHODIC PROTECTION, METHOD FOR THE PRODUCTION OF A PART USING SUCH A SHEET, AND RESULTING PART

(75) Inventors: Christian Allely, Metz (FR); Julie Chassagne, Liège (BE); Beril Corlu, Gent (BE)

(73) Assignee: ArcelorMittal Investigacion y Desarrollo, S.L. (ES)

( * ) Notice: Subject to any disclaimer, the term of this patent is extended or adjusted under 35 U.S.C. 154(b) by 508 days.

(21) Appl. No.: 14/394,885

(22) PCT Filed: Apr. 17, 2012

(86) PCT No.: PCT/FR2012/000149

§ 371 (c)(1),
(2), (4) Date: Jun. 17, 2015

(87) PCT Pub. No.: WO2013/156688

PCT Pub. Date: Oct. 24, 2013

(65) Prior Publication Data

US 2015/0284861 A1 Oct. 8, 2015

(51) Int. Cl.

| | |
|---|---|
| ***C23F 13/14*** | (2006.01) |
| ***C21D 6/00*** | (2006.01) |
| ***C22C 38/00*** | (2006.01) |
| ***C21D 8/00*** | (2006.01) |
| ***C23C 2/04*** | (2006.01) |
| ***C23C 2/12*** | (2006.01) |
| ***C23C 2/28*** | (2006.01) |
| ***C21D 8/02*** | (2006.01) |
| ***C21D 9/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/40*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |

(Continued)

(52) U.S. Cl.

CPC ..... *C23F 13/14* (2013.01); *C21D 6/001* (2013.01); *C21D 6/002* (2013.01); *C21D 6/004* (2013.01); *C21D 6/005* (2013.01); *C21D 6/008* (2013.01); *C21D 8/005* (2013.01); *C21D 8/0278* (2013.01); *C21D 9/0068* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/26* (2013.01); *C22C 38/28* (2013.01); *C22C 38/32* (2013.01); *C22C 38/38* (2013.01); *C22C 38/40* (2013.01); *C22C 38/42* (2013.01); *C22C 38/44* (2013.01); *C22C 38/48* (2013.01); *C22C 38/50* (2013.01); *C22C 38/54* (2013.01); *C22C 38/58* (2013.01); *C23C 2/04* (2013.01); *C23C 2/12* (2013.01); *C23C 2/28* (2013.01); *C21D 1/673* (2013.01); *C21D 9/46* (2013.01)

(58) Field of Classification Search

CPC .. C23F 13/14; C21D 6/00; C21D 8/00; C22C 38/00

See application file for complete search history.

(56) References Cited

U.S. PATENT DOCUMENTS

| | | | |
|---|---|---|---|
| 6,635,359 | B1 | 10/2003 | Kurosaki et al. |
| 2009/0238715 | A1 | 9/2009 | Cho et al. |

(Continued)

FOREIGN PATENT DOCUMENTS

| | | | | |
|---|---|---|---|---|
| CN | 1369020 | A | 9/2002 | |
| CN | 1924075 | A | 3/2007 | |
| EP | 1 225 246 | A1 * | 7/2002 | ..... C23C 2/12 |
| EP | 1225246 | A1 | 7/2002 | |
| EP | 1760166 | A2 | 3/2007 | |
| JP | 2001323357 | A | 11/2001 | |

(Continued)

*Primary Examiner* — Robert D. Harlan

(74) *Attorney, Agent, or Firm* — Davidson, Davidson & Kappel, LLC; Jennifer L. O'Connell

(57) ABSTRACT

This invention relates to a steel sheet provided with a sacrificial cathodic protection layer comprising from 5 to 50% zinc by weight, from 0.1 to 15% silicon by weight and optionally up to 10% magnesium by weight and up to 0.3% by weight, in cumulative content, of additional elements, and also comprising a protection elements to be selected from among tin in a percentage by weight between 0.1 and 5%, indium in a percentage by weight between 0.01 and 0.5% and combinations thereof, the balance consisting of aluminum and residual elements or unavoidable impurities. The invention further relates to a method for the fabrication of parts by hot or cold stamping and the parts that can be thereby obtained.

19 Claims, No Drawings

(51) Int. Cl.

| | |
|---|---|
| ***C22C 38/58*** | (2006.01) |
| *C21D 1/673* | (2006.01) |
| *C21D 9/46* | (2006.01) |

(56) References Cited

U.S. PATENT DOCUMENTS

| | | | |
|---|---|---|---|
| 2013/0029172 | A1 | 1/2013 | Drillet et al. |
| 2013/0206284 | A1 | 8/2013 | Norden et al. |

FOREIGN PATENT DOCUMENTS

| | | | |
|---|---|---|---|
| JP | 2010508438 | A | 3/2010 |
| JP | 2010070784 | A | 4/2010 |
| KR | 20040006479 | | 1/2004 |
| WO | 2011157690 | A1 | 12/2011 |

* cited by examiner

STEEL SHEET PROVIDED WITH A COATING OFFERING SACRIFICIAL CATHODIC PROTECTION, METHOD FOR THE PRODUCTION OF A PART USING SUCH A SHEET, AND RESULTING PART

This invention relates to steel sheet provided with a sacrificial cathodic protection coating, intended in particular for the fabrication of automobile parts, although it is not limited to that application.

Currently, only zinc or zinc alloy coatings provide a heightened degree of protection against corrosion on account of a dual barrier and cathodic protection. The barrier effect is obtained by the application of the coating to the surface of the steel, which thereby prevents any contact between the steel and the corrosive medium and is independent of the nature of the coating and of the substrate. On the other hand, the sacrificial cathodic protection is based on the fact that zinc is a metal that is less noble than steel and that, under corrosion conditions, zinc is consumed before the steel. This cathodic protection is in particular essential in zones where the steel is directly exposed to the corrosive atmosphere, such as the cut edges or the injured zones where the steel is bare and where the surrounding zinc will be consumed before any attack on the uncoated zone.

Nevertheless, on account of its low melting point, zinc poses problems when the parts must be welded because there is a risk that the zinc will vaporize. One possible way to remedy this problem is to reduce the thickness of the coating, although that limits the length of time the surface is protected against corrosion. In addition, when the sheet is to be press-hardened, in particular by hot stamping, the formation of microcracks in the steel that propagate from the coating is observed. Likewise, the painting of certain parts previously coated with zinc and then press-hardened requires a sandblasting operation before zinc phosphate coating on account of the presence of a layer of brittle oxide on the surface of the part.

The other family of metal coatings commonly used for the production of automobile parts is the family of coatings based on aluminum and silicon. These coatings do not cause micro-cracking in the steel when they are deformed on account of the presence of a layer of intermetallic Al—Si—Fe and have a good suitability for painting. Although they make it possible to obtain protection by the barrier effect and are weldable, they do not provide cathodic protection.

The object of this invention is therefore to remedy the disadvantages of the coatings of the prior art by making available coated steel sheets that have a high degree of protection against corrosion before and after processing by stamping in particular. When the sheets are intended for press-hardening, in particular by hot stamping, it is also desirable to have resistance to the propagation of microcracks in the steel and preferably the largest possible window of utilization in terms of time and temperature during the heat treatment that precedes the press hardening.

In terms of surface cathodic protection, the objective is to achieve an electrochemical potential that is at least 50 mV more negative than that of the steel, i.e. a minimum value of −0.75 V in relation to a saturated calomel electrode (SCE). However, it is undesirable to go below the value of −1.4 V, or even −1.25 V, which would result in an excessively rapid consumption of the coating and would ultimately reduce the length of time the steel is protected.

For this purpose, the object of the invention is a steel sheet provided with a sacrificial cathodic protection coating comprising from 5 to 50% zinc by weight, from 0.1 to 15% silicon by weight and optionally up to 10% magnesium by weight and up to 0.3% by weight, in cumulative concentrations, of additional elements, and also including one protection element to be selected from among tin in a percentage by weight between 0.1% and 5%, indium in a percentage by weight between 0.01 and 0.5% and combinations thereof, the balance consisting of aluminum and residual elements or unavoidable impurities.

The sheet claimed by the invention can also incorporate the following characteristics, considered individually or in combination:

- the protective element of the coating is tin in a percentage by weight between 1% and 3%,
- the protective element of the coating is indium in a percentage by weight between 0.02% and 0.1%,
- the coating includes from 20 to 40% zinc by weight, and optionally magnesium in a concentration of 1 to 10% by weight,
- the coating includes from 20 to 30% zinc by weight and optionally magnesium in a concentration of 3 to 6% by weight,
- the coating includes from 8% to 12% silicon by weight,
- the coating includes as a residual element a concentration of 2 to 5% iron by weight,
- the steel of the sheet includes, in percent by weight, 0.15%<C<0.5%, 0.5%<Mn<3%, 0.1%<silicon<0.5%, Cr<1%, Ni<0.1%, Cu<0.1%, Ti<0.2%, Al<0.1%, P<0.1%, S<0.05%, 0.0005%<B<0.08%, the remainder consisting of iron and unavoidable impurities due to the processing of the steel,
- the coating has a thickness between 10 and 50 μm,
- the coating is obtained by hot dipping.

An additional object of the invention consists of a method for the fabrication of a steel part provided with a sacrificial cathodic protection coating comprising the following steps, carried out in this order and consisting of:

- procurement of a steel sheet claimed by the invention, previously coated, then
- cutting the sheet to obtain a blank, then
- heating the blank in a non-protective atmosphere to an austenitization temperature Tm between 840 and 950° C.,
- holding the blank at this temperature Tm for a length of time tm between 1 and 8 minutes, then
- hot stamping the blank to obtain a coated steel part that is cooled at a rate such that the microstructure of the steel comprises at least one component selected from martensite and bainite,
- wherein the temperature Tm, the time tm, the thickness of the previous coating and its concentrations of protective element, of zinc and optionally magnesium, are selected so that the final average concentration of iron in the upper portion of the coating of said part is less than 75% by weight.

In one preferred embodiment, the thickness of the previous coating is greater than or equal to 27 μm, its tin content is greater than or equal to 1% by weight and its zinc content is greater than or equal to 20% by weight.

An additional object of the invention consists of a part provided with a sacrificial cathodic protective coating that can be obtained by the method claimed by the invention or by cold stamping of a sheet claimed by the invention, and which is intended in particular for use in the automotive industry.

The invention will be described in greater detail below with reference to particular embodiments which are illustrated by way of nonrestrictive examples.

As will be demonstrated, the invention relates to a steel sheet provided with a coating comprising first of all a protective element selected from tin, indium and combinations thereof.

In light of their respective availability in the market, preference is given to the use of tin in a percentage between 0.1% and 5%, preferably between 0.5 and 4% by weight, more preferably between 1% and 3% by weight, or even between 1% and 2% by weight. However, consideration can be given to the use of indium, which has greater protective ability than tin. It can be used alone or in addition to tin, in concentrations between 0.01 and 0.5%, preferably between 0.02 and 0.1%, and most preferably between 0.05 and 0.1% by weight.

The coatings of sheets claimed by the invention also include 5 to 50% zinc by weight and optionally up to 10% magnesium. The inventors have found that these elements make it possible, in association with the protection elements mentioned above, to reduce the electrochemical potential of the coating in relation to the steel in environments that do or do not contain chloride ions. The coatings claimed by the invention therefore offer sacrificial cathodic protection.

Preference is given to the use of zinc, the protective effect of which is greater than that of magnesium, and which is easier to use because it is less oxidizable. In addition, preference is given to the use of 10 to 40%, from 20 to 40% or even from 20 to 30% zinc by weight, associated or not with 1 to 10% or even 3 to 6% magnesium by weight.

The coatings of sheets claimed by the invention also include from 0.1% to 15%, preferably from 0.5 to 15%, and most preferably from 1 to 15%, or even from 8 to 12% silicon by weight, an element that makes it possible in particular to give the sheet a high level of resistance to high-temperature oxidation. The presence of silicon also makes it possible to use the sheets up to 650° C. without a risk of flaking of the coating. In addition, silicon makes it possible to prevent the formation of a thick layer of intermetallic iron-zinc during a hot dip coating, an intermetallic layer that would reduce adherence and the formability of the coating. The presence of a silicon content greater than 8% by weight also renders the sheet most particularly suitable for press hardening and in particular for forming by hot stamping. Preference is given to the use of a quantity of between 8 and 12% silicon. A concentration greater than 15% by weight is undesirable because it then forms primary silicon, which can degrade the properties of the coating, in particular the corrosion-resistance properties.

The coatings of sheets claimed by the invention can also include, in cumulative concentrations, up to 0.3% by weight, preferably up to 0.1% by weight, or even less than 0.05% by weight, of additional elements such as Sb, Pb, Ti, Ca, Mn, La, Ce, Cr, Ni, Zr or Bi. These different elements can make it possible among other things to improve the corrosion resistance of the coating or even its brittleness or adherence, for example. A person skilled in the art who is familiar with the effects of these elements on the characteristics of the coating will know how to use them as a function of the additional purpose sought, in the proportion appropriate to this effect which will generally be between 20 ppm and 50 ppm. It has also been verified that these elements do not interfere with the principal properties sought in the framework of the invention.

The coatings of the sheets claimed by the invention can also include residual elements and the unavoidable impurities originating, in particular, from the pollution of the hot dip galvanization baths caused by the passage of steel strips or impurities resulting from the ingots used to feed these baths, or the ingots used to supply vacuum deposition processes. Mention can be made in particular of iron as a residual element, which can be present in quantities up to 5% by weight and in general from 2 to 4% by weight in the hot dip coating baths.

Finally, the coatings of the sheets claimed by the invention include aluminum, the content of which can run from approximately 20% to almost 90% by weight. This element makes it possible to provide protection against corrosion of the sheet by the barrier effect. It increases the melting temperature and the evaporation temperature of the coating, thereby making it possible to use the sheets more easily for hot stamping in particular and over an extended range of times and temperatures. This can be particularly attractive when the composition of the steel of the sheet and/or the final microstructure of the piece require it to undergo austenitization at high-temperatures and/or for long periods of time.

It will therefore be understood that, depending on the properties required for the parts claimed by the invention, the majority element in the coating can be zinc or aluminum.

The thickness of the coating will preferably be between 10 and 50 μm. Below 10 μm, protection of the strip against corrosion may be insufficient. Above 50 μm, protection against corrosion exceeds the required level, in particular in the automotive field. In addition, if a coating with a thickness in this range is subjected to a significant temperature increase and/or during long periods of time, there is a risk that the upper portion of the coating may melt and run onto the rollers of the furnace or into the stamping dies, which would damage them.

With regard to the steel used for the sheet claimed by the invention, the type of steel is not critical, provided that the coating can adhere to it sufficiently.

However, for certain applications that require high levels of mechanical strength such as structural parts for automobiles, preference is given to a steel that has a composition that enables the part to have a tensile strength of 500 to 1600 MPa, depending on the conditions under which the part will be used.

In this range of strengths, preference is given in particular to the use of a steel composition comprising, in percent by weight: $0.15\%<C<0.5\%$, $0.5\%<Mn<3\%$, $0.1\%<Si<0.5\%$, $Cr<1\%$, $Ni<0.1\%$, $Cu<0.1\%$, $Ti<0.2\%$, $Al<0.1\%$, $P<0.1\%$, $S<0.05\%$, $0.0005\%<B<0.08\%$, the balance consisting of iron and unavoidable impurities resulting from the processing of the steel. One example of a commercially available steel is 22MnB5.

When the desired level of strength is on the order of 500 MPa, preference is given to the use of a steel composition comprising: $0.040\%\leq C\leq 0.100\%$, $0.80\%\leq Mn\leq 2.00\%$, $Si\leq 0.30\%$, $S\leq 0.005\%$, $P\leq 0.030\%$, $0.010\%\leq Al\leq 0.070\%$, $0.015\%\leq Nb\leq 0.100\%$, $0.030\%\leq Ti\leq 0.080\%$, $N\leq 0.009\%$, $Cu\leq 0.100\%$, $Ni\leq 0.100\%$, $Cr\leq 0.100\%$, $Mo\leq 0.100\%$, $Ca\leq 0.006\%$, the remainder consisting of iron and unavoidable impurities resulting from the processing of the steel.

The steel sheets can be fabricated by hot rolling and can optionally be re-rolled cold, depending on the desired final thickness, which can vary, for example, between 0.7 and 3 mm.

They can be coated by any suitable means such as an electrodeposition method or by a vacuum deposition method or deposition under pressure close to atmospheric pressure, such as by a sputtering magnetron, cold plasma or vacuum evaporation, for example, although preference is given to obtaining them by a hot dip coating method in a bath of molten metal. It has been noted that the surface cathodic protection is greater for coatings obtained by hot dipping than for coatings obtained by other coating methods.

The sheets claimed by the invention can then be formed using any method appropriate to the structure and the form of the parts to be fabricated, such as cold stamping, for example.

However, the sheets claimed by the invention are most particularly suitable for the fabrication of press-hardened parts, in particular by hot stamping.

This method consists of procuring a steel sheet claimed by the invention which has previously been coated, then cutting the sheets to obtain a blank. This blank is then heated in a furnace under a non-protective atmosphere to an austenitization temperature Tm between 840 and 950° C., preferably between 880 and 930° C., then holding the blank at this temperature Tm for a period tm between 1 and 8 minutes, preferably between 4 and 6 minutes.

The temperature Tm and the hold time tm depend on the nature of the steel but also on the thickness of the sheets to be stamped, which must be entirely in the austenitic range before their shaping. The higher the temperature Tm, the shorter the hold time tm will be and vice-versa. In addition, the rate at which the temperature is increased also influences these parameters, whereby a high rate of increase (greater than 30° C. per second, for example) also makes it possible to reduce the hold time tm.

The blank is then transferred to a hot stamping die and stamped. The part obtained is then cooled either in the stamping die itself or after transfer into a specific cooling die.

The rate of cooling is in all cases controlled as a function of the composition of the steel, so that its final microstructure upon completion of the hot stamping includes at least one constituent selected from martensite and bainite, to achieve the desired level of mechanical strength.

An essential point to guarantee that the coated and hot stamped part will indeed have sacrificial cathodic protection is to regulate the temperature Tm, the time tm, the thickness of the previous coating and its concentration of protective elements, zinc and optionally magnesium, such that the final average concentration of iron in the upper portion of the coating of the part is less than 75% by weight, preferably less than 50% by weight, or even less than 30% by weight. This upper part has a thickness of at least 5 μm.

Under the effect of the heating to the austenitization temperature Tm, the iron originating from the substrate diffuses into the previously applied coating and increases its electrochemical potential. To maintain satisfactory cathodic protection, it is therefore necessary to limit the average iron content in the upper portion of the final coating of the part.

To do that, it is possible to limit the temperature Tm and/or the hold time tm. It is also possible to increase the thickness of the prior coating to prevent the diffusion front of the iron from reaching the surface of the coating. In this regard, preference is given to the use of a sheet that has a prior coating thickness greater than or equal to 27 μm, preferably greater than or equal to 30 μm or even 35 μm.

To limit the loss of cathodic protective capability of the final coating, the contents of the protective element(s), zinc and optionally magnesium in the prior coating can also be increased.

The technician skilled in the art will in any case be able to adapt these different parameters, also taking into consideration the nature of the steel, to obtain a press hardened coated steel part, in particular a hot stamped part, that exhibits the qualities required by the invention.

Tests have been conducted to illustrate certain embodiments of the invention.

TESTS

Example 1—Al—Si—Zn—In—Fe Coating

Tests have been conducted with 22MnB5 cold rolled sheets 1.5 mm thick provided with hot dip coatings comprising, in percent by weight, 20% zinc, 10% silicon, 3% iron, 0.1% indium, the remainder consisting of aluminum and unavoidable impurities, and the thicknesses of which are approximately 15 μm.

These sheets were subjected to conventional electrochemical measurements in a 5% NaCl environment, with reference to a saturated calomel electrode.

It was noted that the electrochemical potential of the coated sheet is −0.95 V/SCE. The sheet claimed by the invention therefore does have sacrificial cathodic protection. Under the same measurement conditions, it was verified that a sheet that was identical but was provided with a coating that contained neither zinc nor indium had an electrochemical potential of −0.70 V/SCE, which does not provide cathodic protection to the steel.

To evaluate the residual protection after hot stamping, additional tests consisted of heating the sheets claimed by the invention, which were identical to those previously used, to a temperature of 900° C. for variable lengths of time. It was observed that the electrochemical potential of the sheet treated for 3 minutes is still −0.95 V/SCE, thereby demonstrating the preservation of the sacrificial cathodic protection. Above this processing temperature, the average iron content of the upper part of the coating over a thickness of 5 μm is greater than 75% by weight and the electrochemical potential falls to −0.70 V/SCE.

With regard to the propagation of micro-cracks from the coating to the sheet, the formation of a thick intermetallic layer was observed at the steel-coating interface, an intermetallic layer that is still present upon completion of the austenitization.

Example 2—Al—Si—Zn—Mg—Sn—Fe Coating

Tests have been conducted with cold-rolled 22MnB5 sheet 1.5 mm thick provided with hot dip coatings comprising, in percent by weight, 10% silicon, 10% zinc, 6% magnesium, 3% iron and 0.1% tin, the remainder consisting of aluminum and unavoidable impurities, and the average thicknesses of which are 17 μm.

These sheets were subjected to conventional electrochemical measurements in a 5% NaCl environment, with reference to a saturated calomel electrode.

It was noted that the electrochemical potential of the coated sheet is −0.95 V/SCE, while the electrochemical potential of an identical sheet provided with a coating containing 10% silicon, and the rest consisting of aluminum and unavoidable impurities, is −0.70 V/SCE. The sheet claimed by the invention therefore does have sacrificial cathodic protection.

To evaluate the residual protection after hot stamping, additional tests consisted of heating the sheets claimed by the invention, which were identical to those previously used, to a temperature of 900° C. for variable lengths of time. It was observed that the electrochemical potential of the sheet treated for 2 minutes is still −0.95 V/SCE, thereby demonstrating the preservation of the sacrificial cathodic protection. Above this processing temperature, the average iron content of the upper portion of the coating over a thickness of 5 μm is greater than 75% by weight and the electrochemical potential falls to −0.70 V/SCE.

It was then verified that the use of a coating with an average thickness of 27 μm makes it possible to increase the duration of austenitization Tm to 5 minutes at 900° C. with preservation of this cathodic protection.

With regard to the propagation of microcracks from the coating to the sheet, the formation of a thick intermetallic layer was observed at the steel-coating interface, an intermetallic layer that is still present at the conclusion of the austenitization.

Example 3—Al—Zn—Si—Sn—Fe Coatings with or without in

Similar additional tests were performed with cold-rolled 22MnB5 sheets 1.5 mm thick provided with hot dip coatings, the characteristics of which are presented in the following table, and the thicknesses of which are approximately 32 μm.

| Ref. | % Al | % Zn | % Si | % Sn | % Fe | % In |
|---|---|---|---|---|---|---|
| A | 76 | 10 | 10 | 1 | 3 | — |
| B | 66 | 20 | 10 | 1 | 3 | — |
| C | 56 | 30 | 10 | 1 | 3 | — |
| D | 46 | 40 | 10 | 1 | 3 | — |
| E | 45.9 | 40 | 10 | 1 | 3 | 0.1 |

The results of these tests will confirm that the properties sought by the invention have indeed been achieved.

What is claimed is:

1. A steel sheet provided with a sacrificial cathodic protection coating, the coating comprising:
- zinc, in a percentage by weight from 5 to 50%;
- silicon, in a percentage by weight from 0.1 to 15%,
- iron, in a percentage by weight from 2 to 5%;
- up to 0.3% by weight, in cumulative content, of additional elements, and
- a protection element selected from among tin in a percentage by weight from 0.1% to 5%, indium in a percentage by weight from 0.01 to 0.5% and combinations thereof,
- a balance of the coating consisting of aluminum, residual elements or unavoidable impurities,
- wherein the additional elements include Sb, Pb, Ti, Ca, Mn, La, Ce, Cr, Ni, Zr or Bi.

2. The steel sheet provided with a sacrificial cathodic protection coating as recited in claim 1, the coating further comprising up to 10% magnesium by weight and up to 0.3% by weight, in cumulative content, of additional elements.

3. The steel sheet provided with a sacrificial cathodic protection coating as recited in claim 1, wherein the protection element is tin in a percentage by weight from 1% to 3%.

4. The steel sheet provided with a sacrificial cathodic protection coating as recited in claim 1, wherein the protection element is indium in a percentage by weight from 0.02% to 0.1%.

5. A steel sheet provided with a sacrificial cathodic protection coating, the coating comprising:
- from 20 to 40% zinc by weight;
- from 0.1 to 15% silicon by weight;
- a protection element selected from among tin in a percentage by weight from 0.1% to 5%, indium in a percentage by weight from 0.01 to 0.5% and combinations thereof,
- the balance of the coating including aluminum, residual elements or unavoidable impurities.

6. The steel sheet provided with a sacrificial cathodic protection coating as recited in claim 5, further comprising magnesium in a percentage by weight of 1 to 10%.

7. The steel sheet provided with a sacrificial cathodic protection coating as recited in claim 5, wherein the coating comprises from 20 to 30% zinc by weight.

8. The steel sheet provided with a sacrificial cathodic protection coating as recited in claim 7, further comprising magnesium in a percentage by weight of 3 to 6%.

9. The steel sheet provided with a sacrificial cathodic protection coating as recited in claim 1, wherein the coating comprises from 8% to 12% silicon by weight.

10. The steel sheet provided with a sacrificial cathodic protection coating as recited in claim 1, wherein the steel comprises, in percentage by weight:
- 0.15%<C<0.5%,
- 0.5%<Mn<3%,
- 0.1%<Si<0.5%,
- Cr<1%,
- Ni<0.1%,
- Cu<0.1%,
- Ti<0.2%,
- Al<0.1%,
- P<0.1%,
- S<0.05%, and
- 0.0005%<B<0.08%,
- the balance of the steel including iron and unavoidable impurities due to the processing of the steel.

11. The steel sheet provided with a sacrificial cathodic protection coating as recited in claim 1, wherein the coating has a thickness from 10 to 50 μm.

12. The steel sheet provided with a sacrificial cathodic protection coating as recited in claim 1, wherein the coating is obtained by hot dipping the steel sheet.

13. A method for the fabrication of a steel part provided with a sacrificial cathodic protection coating comprising the following steps, carried out in this order:
- procuring a coated steel sheet comprising:
  - zinc, in a percentage by weight from 5 to 50%;
  - silicon, in a percentage by weight from 0.1 to 15%, and
  - a protection element selected from among tin in a percentage by weight from 0.1% to 5%, indium in a percentage by weight from 0.01 to 0.5% and combinations thereof,
  - the balance of the coating including aluminum, residual elements or unavoidable impurities;
- cutting said sheet to obtain a blank;
- heating the blank in a non-protective atmosphere to an austenitization temperature Tm from 840 to 950° C.;
- holding the blank at the austenitization temperature Tm for a time period tm from 1 to 8 minutes;
- hot stamping the blank to obtain a coated steel part which is cooled at a rate so a microstructure of the steel comprises at least one constituent selected from martensite and bainite;
- the temperature Tm, the time tm, a thickness of the coating and percentages of protection elements and zinc and being selected so a final average content of iron in an upper part of the coating of the part is less than 75% by weight.

14. The method as recited in claim 13, further comprising magnesium in the coating.

15. The method as recited in claim 13, wherein a thickness of the coating is greater than or equal to 27 μm and wherein the coating includes tin in a percentage by weight of greater than or equal to 1% and zinc in a percentage by weight of greater than or equal to 20%.

16. A steel part provided with a sacrificial cathodic protection coating obtained by the method as recited in claim 13.

17. A steel part provided with a sacrificial cathodic protection coating obtained by cold stamping of the steel sheet recited in claim 1.

18. A steel sheet provided with a sacrificial cathodic protection coating, the coating comprising:

zinc, in a percentage by weight from 5 to 50%;

silicon, in a percentage by weight from 8 to 15%, up to 1% magnesium by weight;

up to 0.3% by weight, in cumulative content, of additional elements;

a protection element selected from among tin in a percentage by weight from 0.1% to 5%, indium in a percentage by weight from 0.01 to 0.5% and combinations thereof; and a balance of the coating including aluminum, iron and unavoidable impurities, wherein the additional elements include Sb, Pb, Ti, Ca, Mn, La, Ce, Cr, Ni, Zr or Bi.

19. A steel sheet provided with a sacrificial cathodic protection coating, the coating comprising:

zinc, in a percentage by weight from 5 to 50%;

silicon, in a percentage by weight from 0.1 to 15%, a protection element selected from among tin in a percentage by weight from 0.1% to 5%, indium in a percentage by weight from 0.01 to 0.5% and combinations thereof, and a balance of the coating including aluminum, residual elements or unavoidable impurities;

a final average content of iron in an upper part of the coating of the part being less than 75% by weight.

* * * * *